US005508799A

United States Patent [19]

Irie

[11] Patent Number: 5,508,799

[45] Date of Patent: Apr. 16, 1996

[54] METHOD AND APPARATUS FOR PUNCHING A HOLE IN A STACK OF SHEETS IN AN IMAGE FORMING APPARATUS HAVING A HOLE PUNCHER

[75] Inventor: Yoichiro Irie, Osaka, Japan

[73] Assignee: Mita Industrial Co., Ltd., Osaka, Japan

[21] Appl. No.: 246,343

[22] Filed: May 19, 1994

[30] Foreign Application Priority Data

May 27, 1993 [JP] Japan ..... 5-125952
May 27, 1993 [JP] Japan ..... 5-125953

[51] Int. Cl.[6] ..... G03G 21/00

[52] U.S. Cl. ..... 355/324; 227/2; 270/53

[58] Field of Search ..... 355/324; 227/2; 270/37, 53

[56] References Cited

U.S. PATENT DOCUMENTS

| | | | |
|---|---|---|---|
| 4,421,264 | 12/1983 | Arter et al. | 355/324 X |
| 5,229,812 | 7/1993 | Toyama et al. | 355/324 X |
| 5,230,457 | 7/1993 | Hiroi et al. | 355/324 X |
| 5,241,355 | 8/1993 | Yamashita et al. | 355/324 |
| 5,290,020 | 3/1994 | Matsui et al. | 355/324 X |

FOREIGN PATENT DOCUMENTS 64-34862 2/1989 Japan .

*Primary Examiner*—Fred L. Braun
*Attorney, Agent, or Firm*—Beveridge, DeGrandi, Weilacher & Young

[57] ABSTRACT

A method and apparatus for punching holes in a stack of sheets using a hole puncher. The method includes the steps of activating the hole puncher, determining whether the hole puncher has completely punched a hole in the stack of sheets, and repeating the activating step in response to the determining step until the hole punching is successful. The method also includes determining whether a reference number of unpunched sheets, which is not greater than a single punch capacity of the hole puncher, has been stacked. Upon determining that the reference number of sheets has been reached, the method includes discontinuing the stacking of further sheets and applying a punching operation to the reference number of sheets. The method also includes reinitiating the stacking operation if the number of sheets to be stacked is greater than the reference number of sheets. The invention also includes an apparatus for carrying out the noted method steps. Thus, a large quantity of sheets can be punched under the invention without having to enhance the structure of the hole puncher.

9 Claims, 17 Drawing Sheets

METHOD AND APPARATUS FOR PUNCHING A HOLE IN A STACK OF SHEETS IN AN IMAGE FORMING APPARATUS HAVING A HOLE PUNCHER

BACKGROUND OF THE INVENTION

The present invention relates to a method for punching a hole in a stack of sheets in an image forming apparatus having a hole puncher.

Recently, use of sorters with an image forming apparatus has become wide spread in the field. Particularly, sorters equipped with a hole puncher.

In a sorter incorporating a hole puncher, sheets are sorted and stored in a plurality of bins provided in the sorter, and the stacked sheets are punched by the punching unit.

Although each bin in the sorter is capable of storing 30 or more sheets, the punching unit sometimes can not punch 30 or more sheets. In conventional methods, the number of sheets which are discharged into each bin is detected, and when the detected number exceeds the number of sheets which can be punched by the hole puncher, the punching operation is skipped. However, when that number is within the number of sheets punchable by the hole puncher, the punching operation is carried out and operation continues. However, sheets vary in thickness, therefore even in the instance the number of sheets is within the punching capability of the hole puncher, the stack can not be punched in same cases. In this case, a motor for driving the punch becomes locked up. When it is detected that the motor is locked up, the motor is reversely rotated returning the punch to the initial position, and then the next operation is performed and the hole left unformed. (Japanese Patent Laying-Open No. 34862/1989).

SUMMARY OF THE INVENTION

It is an object of the present invention to improve the method by which a hole is formed in a stack of sheets.

A copying machine equipped with a punching function according to the present invention includes an image forming unit, and a hole punching apparatus. The hole punching apparatus includes a hole puncher, a detector for detecting whether the hole puncher has completely punched a hole in a stack of sheets, and a controller for activating and for reactivating the hole puncher in response to the detector. According to the present invention, when the number of copied sheets reaches a limit of sheets punchable (i.e., the sheet hole-punching units capacity "C") the copying operation is temporarily halted and the punching operation is carried out, whereupon the copy operation is restarted and so on. Thus, a large quantity of sheets can be punched with a hole puncher that is sized for lighter duty operations.

According to another embodiment of the present invention, if a hole has not been completely formed in a stack of sheets by a single punching operation, the punching operation is performed again. Thus, a large quantity of sheets can be punched without requiring a hole puncher of remarkable strength or size.

These and other objects and advantages of the present invention will be more fully apparent from the following detailed description.

DESCRIPTION OF THE PREFERRED EMBODIMENTS

First Embodiment

Overall Structure of a Copying Machine and Sorter Incorporating a Hole Puncher

Figure 1:
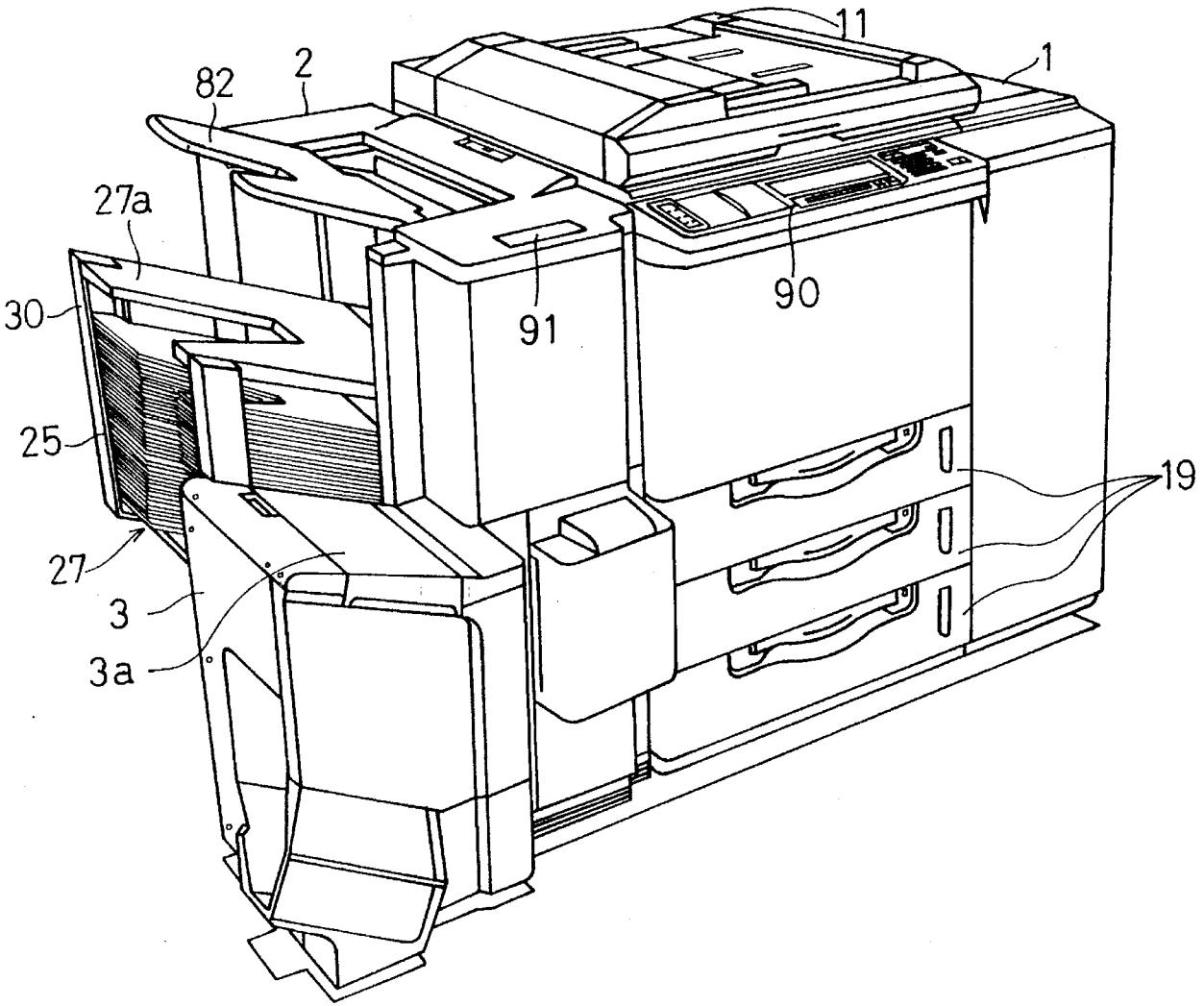
FIG. 1 is a schematic perspective view showing a copying machine according to an embodiment of the present invention.

Referring to FIG. 1, a copying machine includes a copying machine body 1, a sorter 2 incorporating a stapler disposed on the left side of the copying machine body 1 (referred to as a sorter hereinafter), a sheet discharging unit 3 (referred to as a multistacker hereinafter) disposed on the front side (operator side) of the sorter 2.

Figure 2:
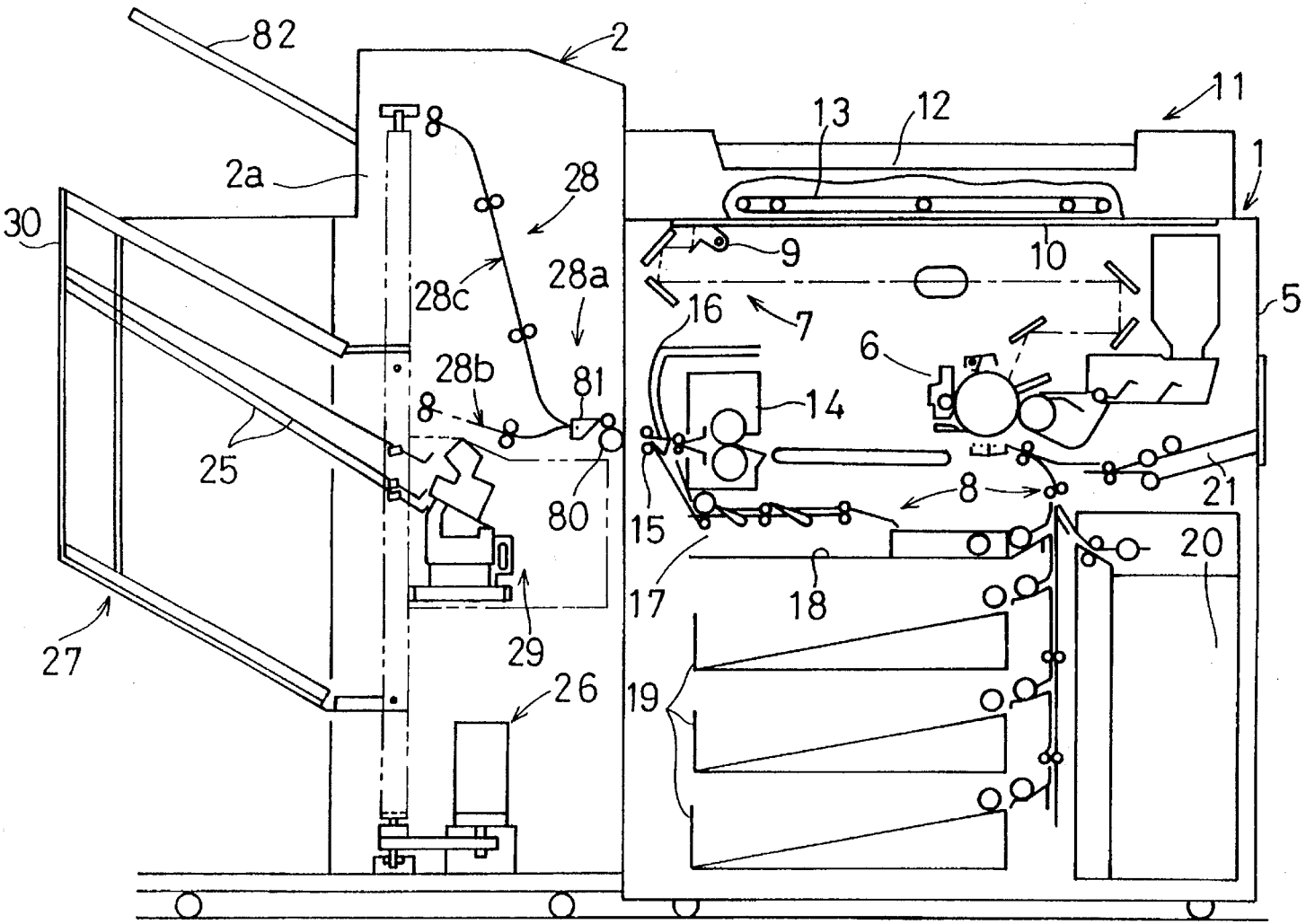
FIG. 2 is a schematic vertical sectional view of the copying machine.

Referring to FIG. 2, the copying machine body 1 includes a case 5, an image forming unit 6 disposed in a central portion of the case 5, an original scanner 7 disposed above the image forming unit 6, and a sheet transporting unit 8 for supplying and discharging sheets into and from the image forming unit 6.

The image forming unit 6 includes a photoconductive drum disposed at the center and a charger, a developing unit, a transfer unit, a detach unit, and a cleaning unit disposed around the photoconductive drum. The original scanner 7 has an optical exposure system 9 disposed above the image forming unit 6, an original retainer 10 disposed over the optical exposure system 9, and an automatic original-transport device 11 provided on the original retainer 10. The automatic original-transport device 11 includes an original receiving portion 12 in an upper surface of its case, and an original transporting unit 13 consisting of an original-transport belt and related elements disposed inside the case. The sheet transporting unit 8 includes a sheet feeding path provided upstream from the image forming unit 6 in the sheet transporting direction, and a sheet discharging path provided downstream from the image forming unit. A fixing unit 14 is provided in the sheet discharging path.

Between the fixing unit 14 and the sorter 2, there are discharge rollers 15 for discharging sheets to the sorter 2, and a reversing device 16 for reversing the sheets. Provided in a lower portion of the case 5, are a middle transport path 17 which transports sheets from the reversing device 16 and a temporary storage tray 18 for temporary storage of the sheets. A plurality of feed cassettes 19 are vertically provided under the storage tray 18. A feed deck 20 for feeding a large quantity of sheets in succession is disposed at the right lower portion of the case 5. A feed path 21 is disposed above the feed deck 20.

Sorter

The sorter 2 includes a bin unit 27 consisting of a plurality of bins 25 and a drive portion 26 for driving the bins vertically, a transport unit 28 disposed between the copying machine body 1 and the bin unit 27, for transporting sheets from the copying machine body 1 to the bin unit 27, a process unit 29 disposed under the transport unit 28 on the right side of the bin unit 27. The bin unit 27 includes a supporting frame 30 supporting the ends of the plurality of bins 25 on the sheet discharging side.

Figure 3:
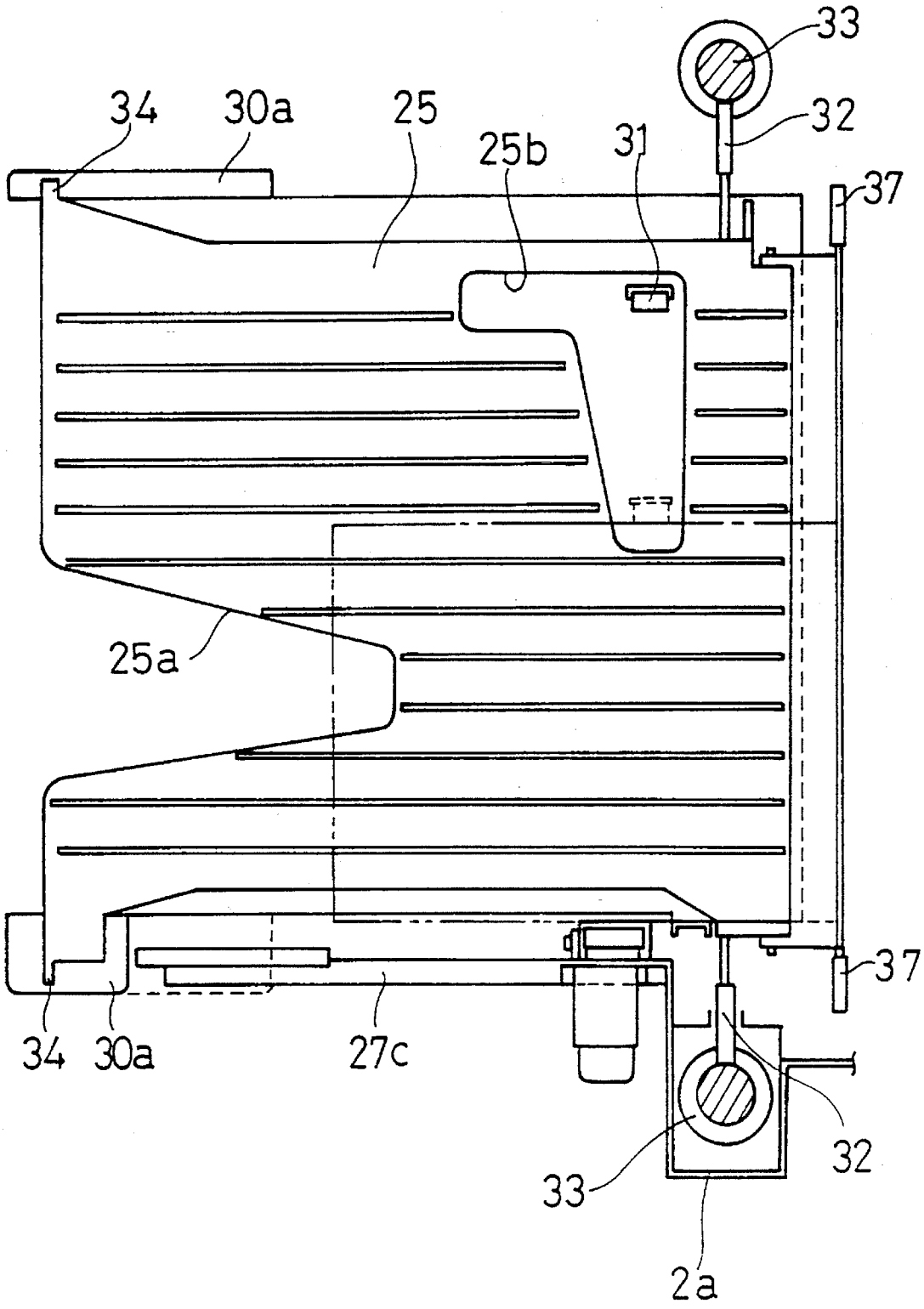
FIG. 3 is a plan view showing a bin used in a sorter of the copying machine.

Each of the bins 25 is formed of a flat board as shown in a plan view of FIG. 3. A cutout 25*a* for discharging the sheets is formed from the forward end (sheet-discharging side) of the bin toward the inside. In addition, two vertically penetrating cutouts 25*b* in which a lateral guide 31 for guiding the sheets toward the front side are provided on the rear side of the bin. A trunnion 32 projecting outward is provided on each side of the bin 25 on the sheet incoming side (the copying machine body side of the bins). The trunnion 32 is engaged with a spiral cam 33 of the drive portion 26. Additionally, a projection 34 projecting outward is formed on each side of the bin 25 on the sheet discharging side. The projection 34 is caught by a holder 30*a* formed in the supporting frame 30.

Figure 4:
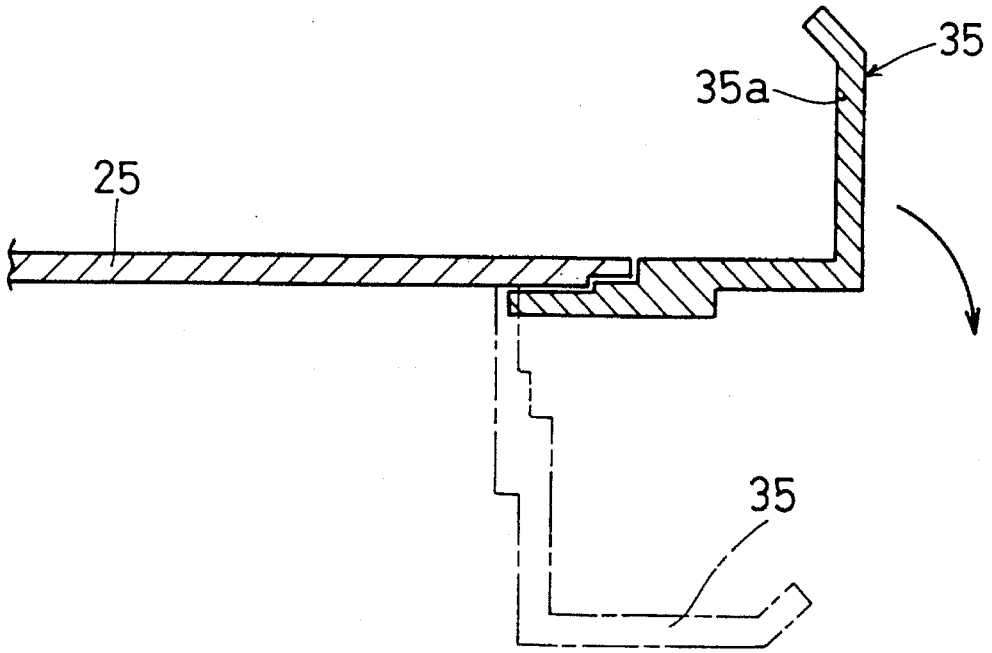
FIG. 4 is a partial sectional view of the bin.
Figure 5:
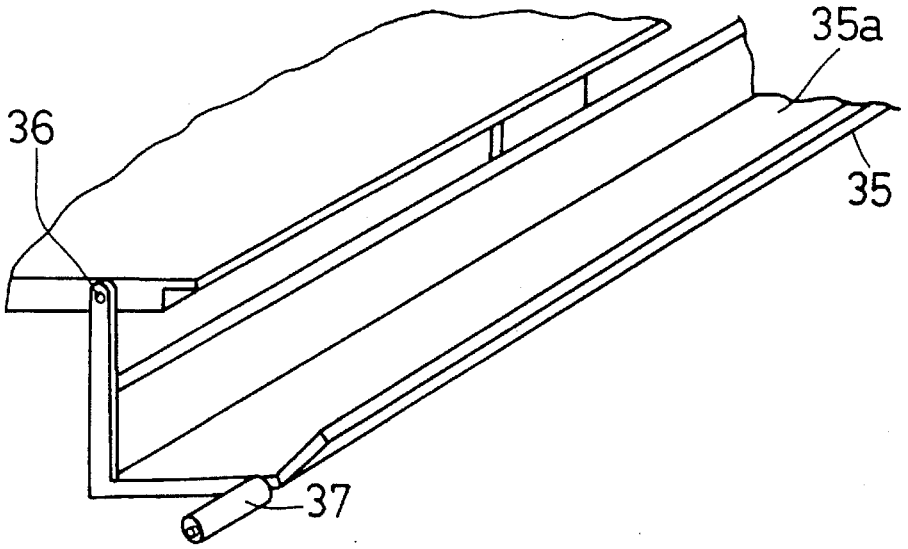
FIG. 5 is a partial perspective view of the bin.

Referring to FIGS. 4 and 5, an L-shaped stopper 35 is mounted to the end of the bin 25 on the copying machine body 1 side. The stopper 35 is rotatably supported to both ends of the bin 25 by pins 36, which is movable between a stopping position indicated by a solid line in FIG. 4 and a withdrawn position indicated by a one-dotted line in the figure. A standing wall 35*a* of the stopper 35 abuts on the trailing edges of sheets stored in the bin 25 in the stopping position, whereby the sheets are prevented from falling. In addition, a guide roller 37 is rotatably mounted to the upper end of the standing wall 35*a* of the stopper 35 as shown in FIGS. 3 and 5. The stopper 35 is placed in the stopping position indicated by the solid line in FIG. 4 in a normal state by an impelling member such as a spring (not shown).

The drive portion 26 of the bin unit 27 includes a pair of spiral cams 33, each of which has a spiral groove on its outer surface, a transmission mechanism consisting of a pulley and a belt, and a drive motor. Although the spiral grooves 33*a* on the outer surface of the spiral cams 33 are formed at a lower pitch at the upper and lower portions, the pitch of the grooves 33*a* at the central portion, opposing the process unit 29, are larger. Thus, the space directly above and below the bin 25 opposed to the process unit 29 is large.

Figure 6:
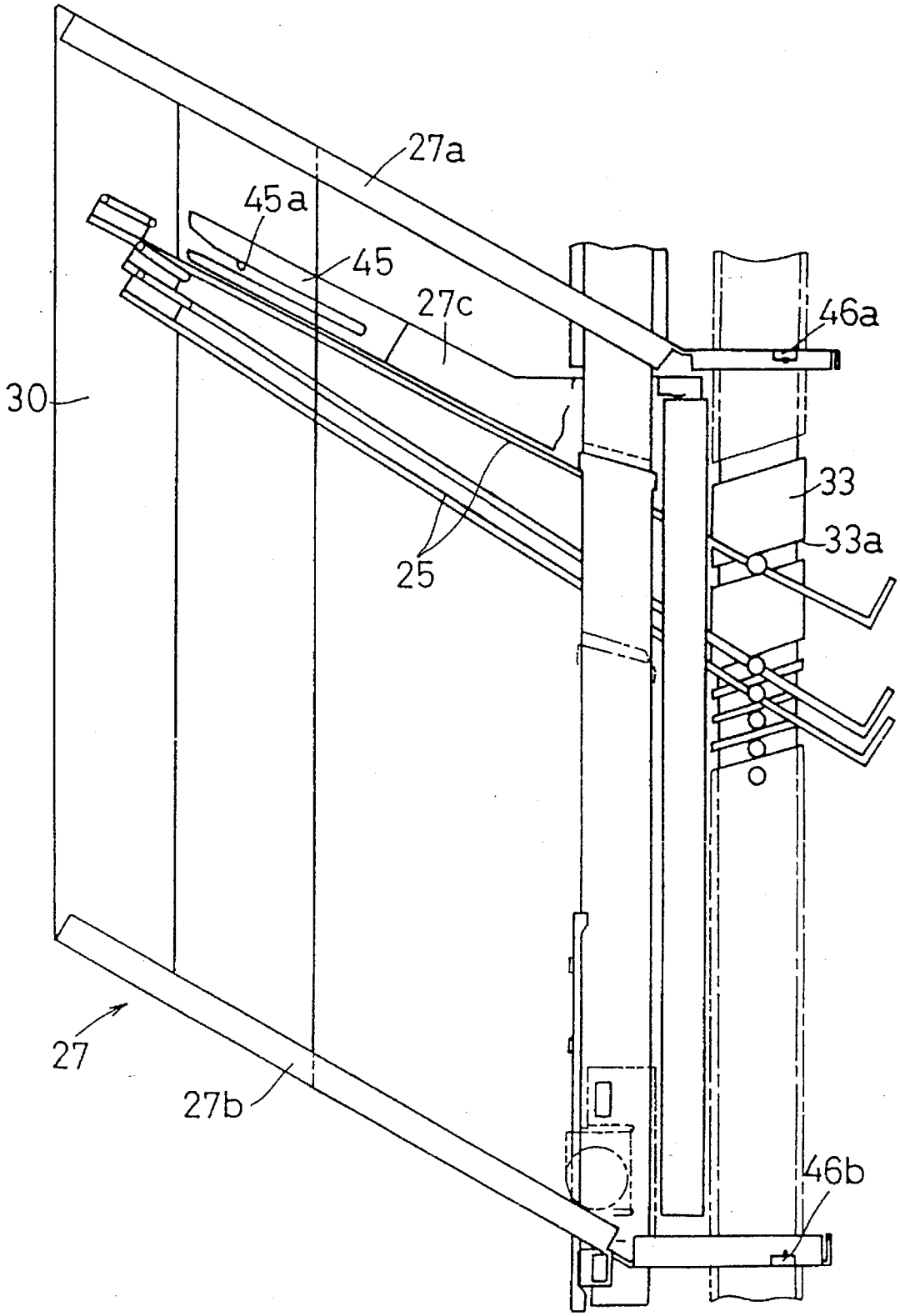
FIG. 6 is a partial vertical sectional view of the sorter.

Referring to FIG. 6, the upper frame 27*a* and the lower frame 27*b* are provided at the upper and lower portions of the bin unit 27, respectively, at almost the same slope as the bins 25. In addition, a bin guide 27*c* is provided on the side of the bin 25 opposed to the process unit 29. The bin guide 27*c* guides the bin 25 when the bin 25 is withdrawn to the copying machine body 1. The ends of the upper and lower frames 27*a* and 27*b* are fixed to the supporting frame 30 and the bottom end of the bin guide 27*c* is fixed to the end of the sorter frame 2*a*. The bin guide 27*c* extends in the sheet discharging direction along the slope of the bin 25. A guide member 45 having a guide groove 45*a* is fixed to the end of the bin guide 27*c*. Additionally, photosensors 46*a* and 46*b* for detecting whether there is any sheet in the bin 25 is provided at the ends of the upper and lower frames 27*a* and 27*b*, respectively, on the sheet incoming side.

In the sorter 2, there is provided a bin moving mechanism (not shown) for moving the bin 25 placed at the processing position toward the process unit 29 and returning it to the original position. In addition, the sorter 2 has a sheet pressing mechanism (not shown) for pressing sheets stored in the bin 25 moving back and forth at a position opposed to the process unit 29. The sheet pressing mechanism integrally moves with the bin 25.

Figure 7:
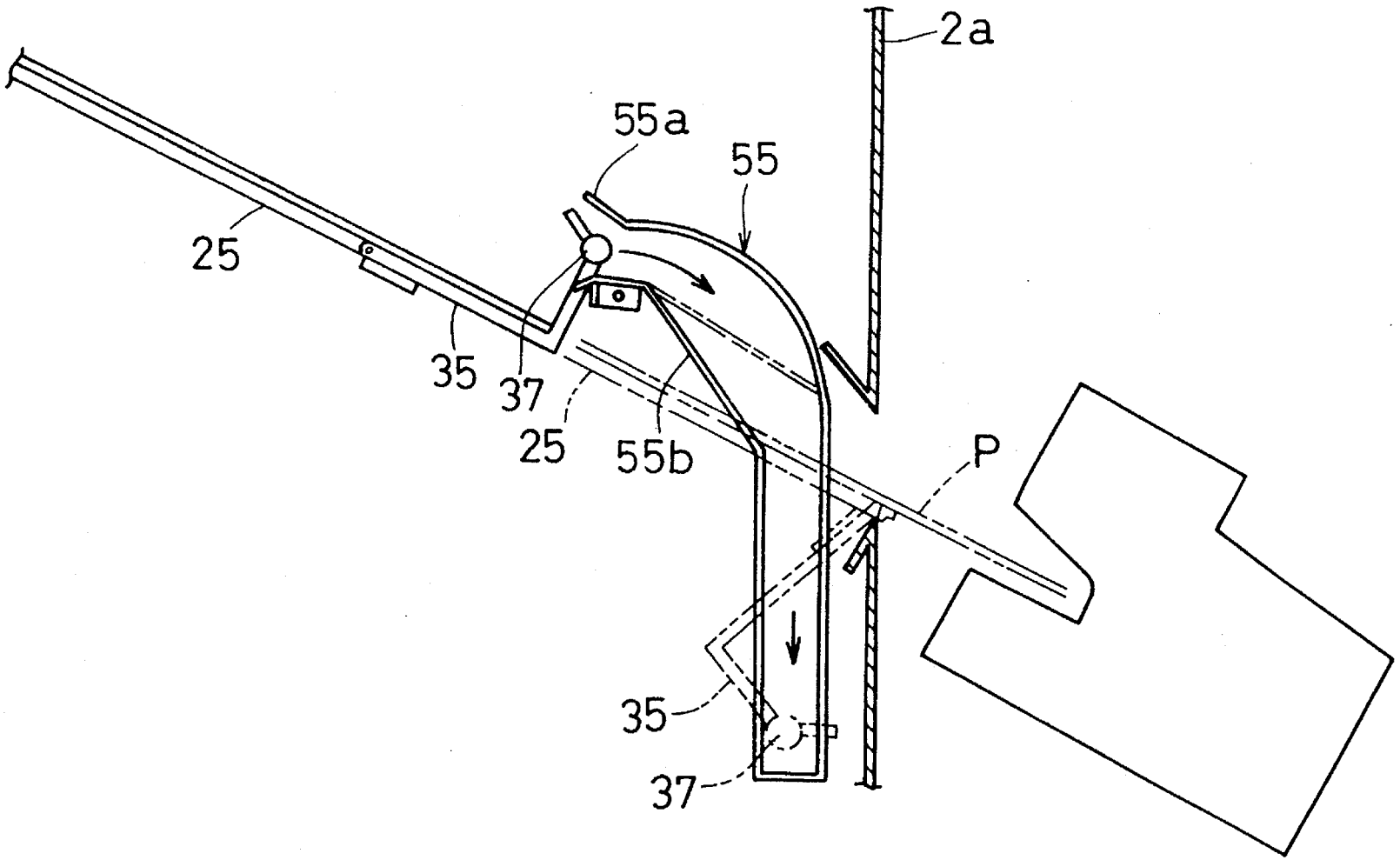
FIG. 7 is a partial sectional view of the sorter.

Referring to FIG. 7, provided in the sorter frame 2*a* is a guide member 55 for releasing the stopper 35 of the bin 25 when the bin 25 is placed at the processing position. The guide member 55 guides the guide roller 37 of the stopper 35 downward. The guide member 55 has upper and lower rails 55*a* and 55*b*.

According to the above structure, when the guide roller 37 is guided by the guide member 55, the bin 25 withdrawn toward the process unit 29 is moved downward, whereby the stopper 35 is rotated in the lower direction and then, the trailing edges of the stacked sheets are exposed. In this state, the trailing edges of the stacked sheets in the bin 25 can be punched or stapled.

Figure 8:
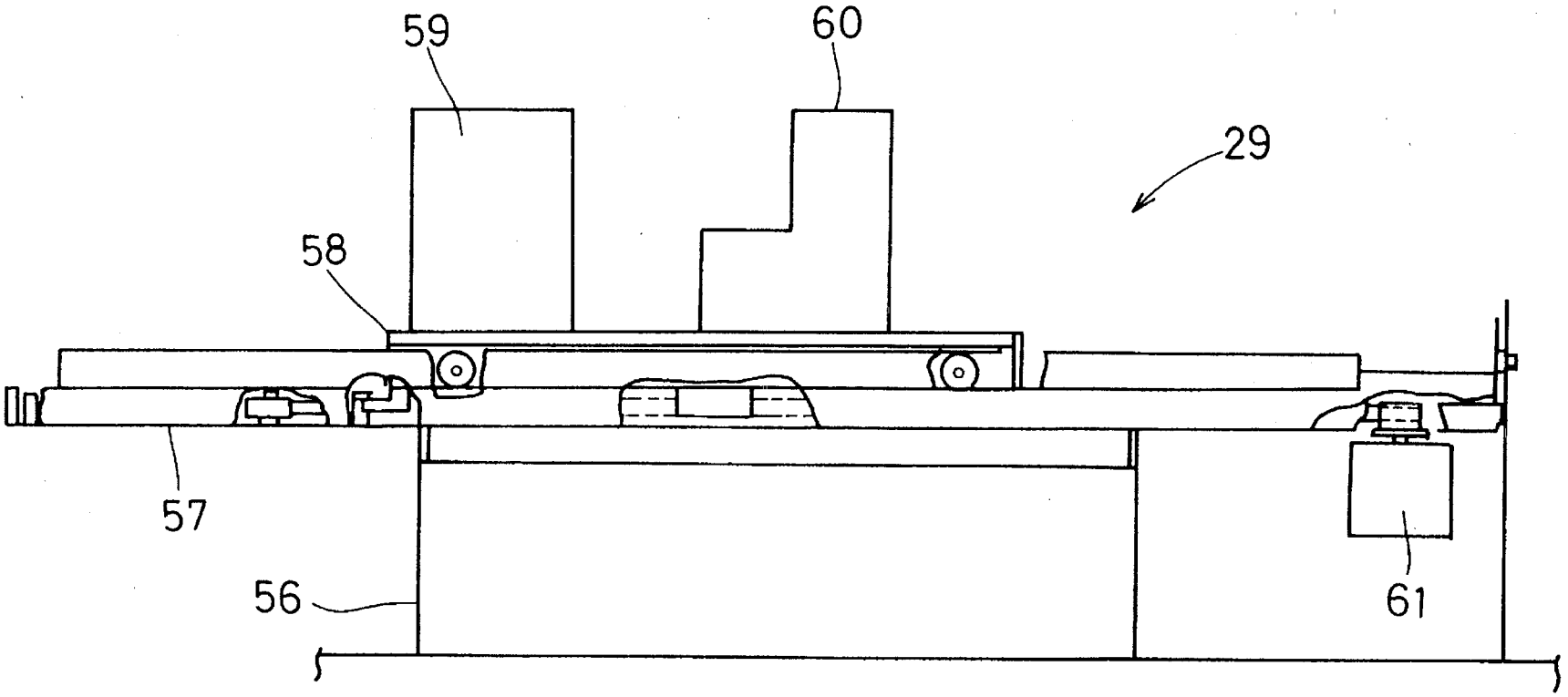
FIG. 8 is a side view showing a moving mechanism of a process unit in the sorter.

Referring to FIG. 8, the process unit 29 includes a fixed frame 56, a base table 57 slidable on the fixed frame 56 and withdrawable toward the front side of the machine, and a moving table 58 movable on the base table 57. A stapler 59 and a punching unit 60 are disposed on the moving table 58. A motor 61 for moving the table is fixed to a lower surface of the base table 57. The moving table 58 is moved on the base table 57 by a moving mechanism including the motor 61.

Figure 9:
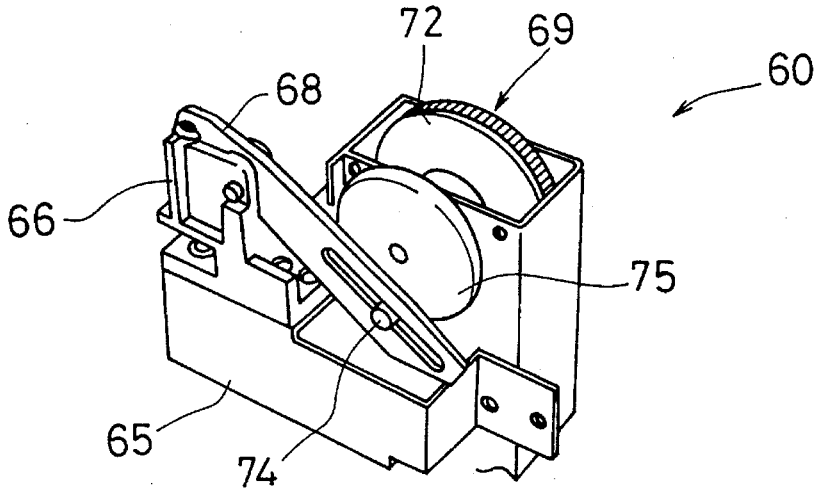
FIG. 9 is a perspective view of a punching unit.
Figure 10:
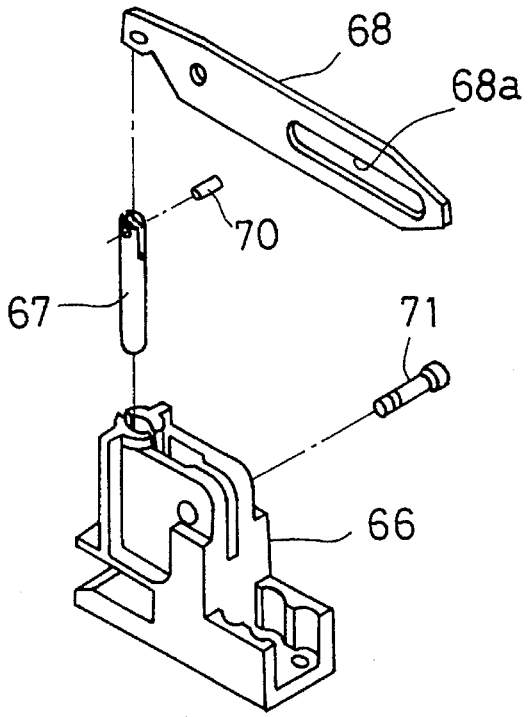
FIG. 10 is an exploded partial perspective view of the punching unit.

FIGS. 9 and 10 show a schematic structure of the hole punching apparatus 60.

Figure 11:
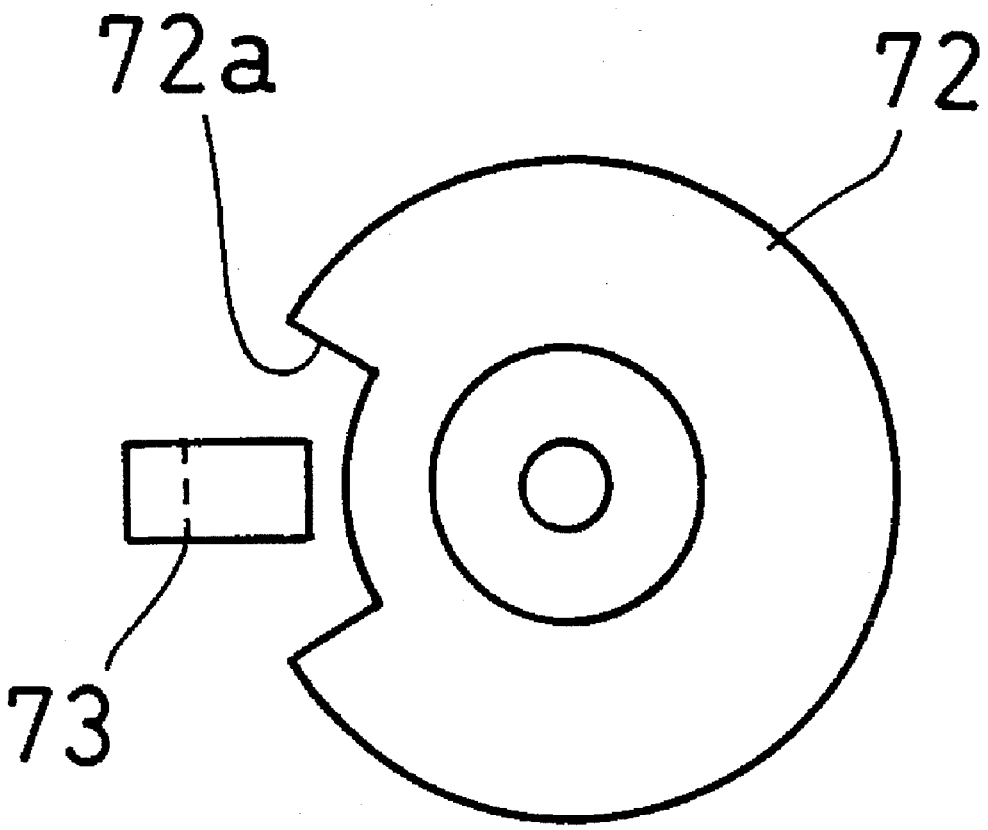
FIG. 11 is a view showing a structure of a position detecting portion of the punching unit.

The punching unit 60 includes a frame 65, a supporting block 66 fixed to the upper portion of the frame 65, a punch 67 liftably supported to the supporting block 66, a lever 68, and a rotary driving unit 69 for driving the punch 67. The punch 67 is rotatably mounted to the end of the lever 68 by a pin 70. The lever 68 is rotatably mounted to the supporting block 66 by a pin 71, and a slot 68*a* is formed in the other end of the lever 68. Meanwhile, the rotary driving unit 69 includes a motor and a gear train transmitting the driving force of the motor. Referring to FIGS. 9 and 11, a positioning plate 72 is fixed to the gear train of the driving unit 69. A cutout 72*a* is formed in a part of the periphery of the plate 72. A photointerrupter 73 is provided in order to detect the cutout 72*a*. A disc plate 75 having a roller 74 on its side surface is fixed to an output portion of the driving unit 69. The roller 74 is inserted into the slot 68*a* of the lever 68.

According to the above structure, when the disc plate 75 is rotated by the driving unit 69, the lever 68 pivots around the pin 71 to lift the punch 67 up and down. The photointerrupter 73 senses cutout 72*a* during rotary motion of the positions plate this detection signifies the time at which the punch 67 has reached its home position.

As shown in FIG. 2, the transport unit 28 of the sorter 2 includes an inlet 28*a*, and transporting paths 28*b* and 28*c* for sorting and for non-sorting, respectively, which are separated from the inlet 28*a*. A guide roller 80 and a claw 81 are provided at the inlet 28*a*. The transporting path 28*b* for sorting is provided between the inlet 28*a* and the bins 25 receiving sorted sheets, and guides the sheets onto the bins 25. The transporting path 28*c* for non-sorting is provided between a bin 82, for receiving non-sorted sheets, and the inlet 28*a*, which guides sheets to the bin 82 when the apparatus is in the non-sorting mode.

Multistacker

Figure 12:
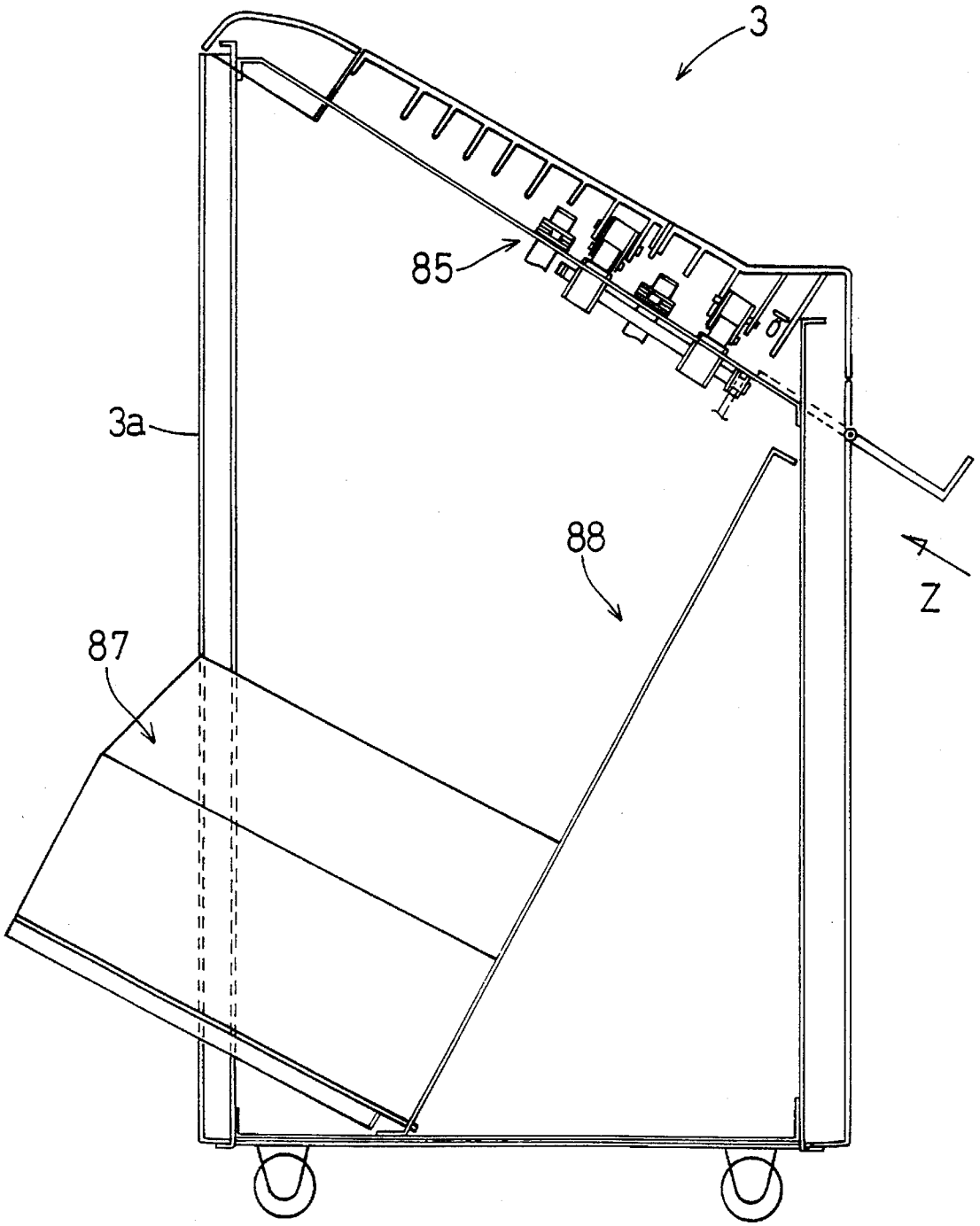
FIG. 12 is a schematic vertical sectional front view of a multistacker of the copying machine.
Figure 13:
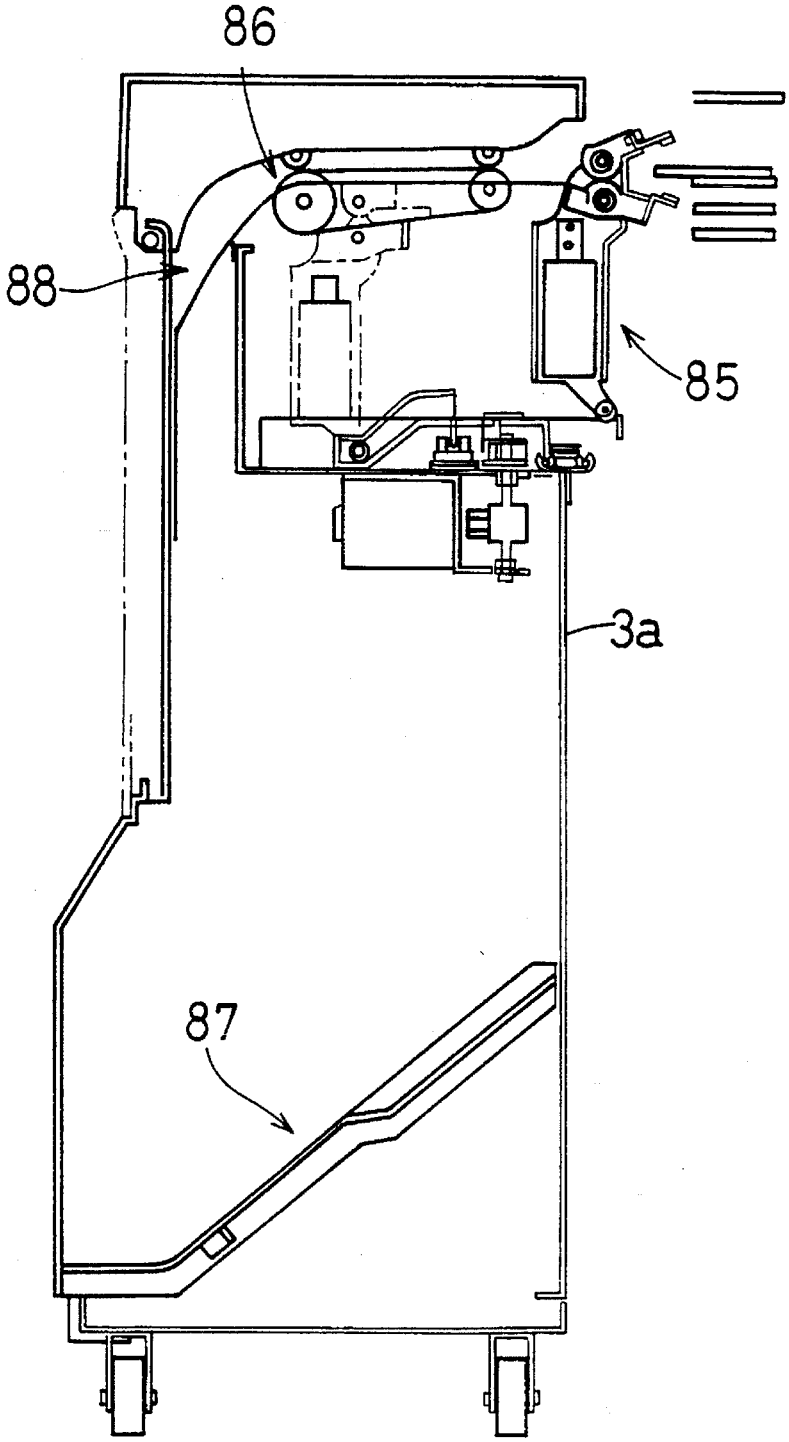
FIG. 13 is a sectional side view of the multistacker.

FIGS. 12 and 13 show an overall structure of the multistacker 3. FIG. 12 is a plan view of the multistacker 3 and FIG. 13 is a side view of the multistacker viewed in the direction indicated by an arrow Z in FIG. 12.

The multistacker 3 includes a case 3*a* and consists of a stacker hand mechanism 85 which holds a processed stack of sheets on the bin 25 placed at a discharging position and withdraws it into the multistacker 3, a discharging mechanism 86 discharging the stack of sheets withdrawn toward the front side of the machine by the stacker hand mechanism 85, a stack portion 87 storing the discharged stacks of sheets, and a sheet transport path 88 guiding the stack of sheets from the bin 25 into the stack portion 87.

Control Unit

As shown in FIG. 1, an operation panel 90 for operating the copying machine body 1 is provided on the upper surface of the copying machine body 1 on the front side thereof. The operation panel 90 includes a key for specifying an operation mode, a key for specifying a stapling or punching position, decimal keys setting the number of copies, and other keys.

There is disposed an operation panel 91 on front upper side of the sorter 2, through which an operator directly inputs a command to the sorter 2. The operation panel 91 includes a multikey for performing stapling and punching operations and an operation for discharging the stacked sheets from the bin in parallel, and other associated keys. By pressing the multikey, the stacked sheets in the bin can be compulsorily discharged to the stack portion 87.

Figure 14:
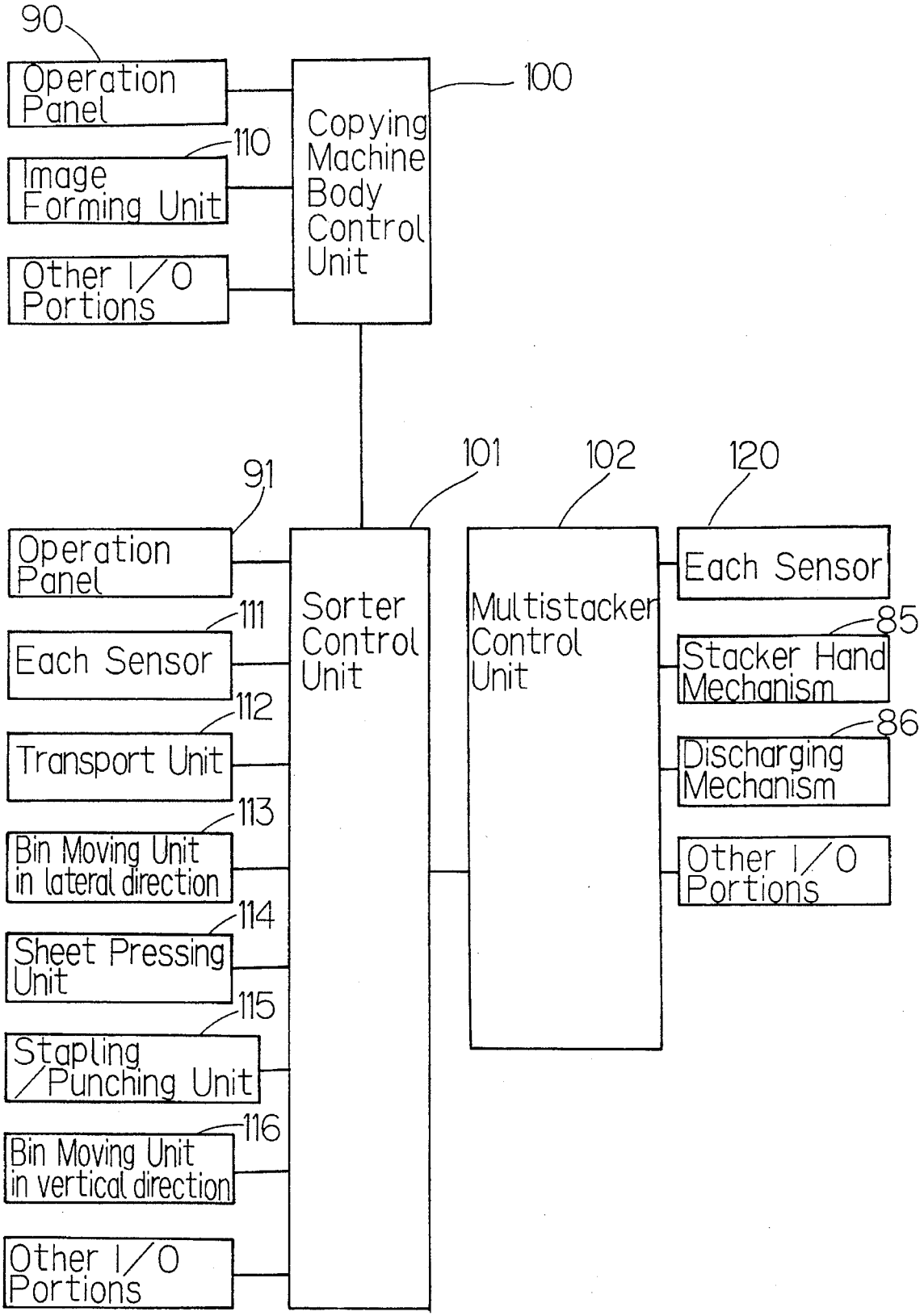
FIG. 14 is a control block diagram of the copying machine.

FIG. 14 shows a schematic control block diagram of the copying machine.

The copying machine body 1 includes a copying machine body control unit 100 controlling a copying operation and an operation of an automatic original transport unit 11 in the copying machine body 1; the sorter 2 includes a sorter control unit 101; and the multistacker 3 includes a multistacker control unit 102, Each of the control units 100,101 and 102 includes a microcomputer comprising a CPU, a RAM and a ROM. The control units 100, 101 and 102 are connected through a bus, whereby several kinds of information can be interchanged among the control units.

Connected to the copying machine body control unit 100 are the operation panel 90, an image forming unit 110 and other I/O portions. Corrected to the sorter control unit 101 are the operation panel 91, several kinds of sensors 111, including a sensor for detecting the number of sheets introduced into each bin and the like, the sheet transport unit 112, a bin moving unit 113 moving the bin in the lateral direction, a sheet pressing unit 114 for pressing the stacked sheets in the bin 25, a stapling and punching unit 115, a bin moving unit 116 for moving the bins in the vertical direction, and other I/O portions. Corrected to the multistacker control unit 102 are several kinds of sensors 120, the stacker hand mechanism 85, the discharging mechanism 86 and other I/O portions.

Operation of Copying Machine Body

Figure 15:
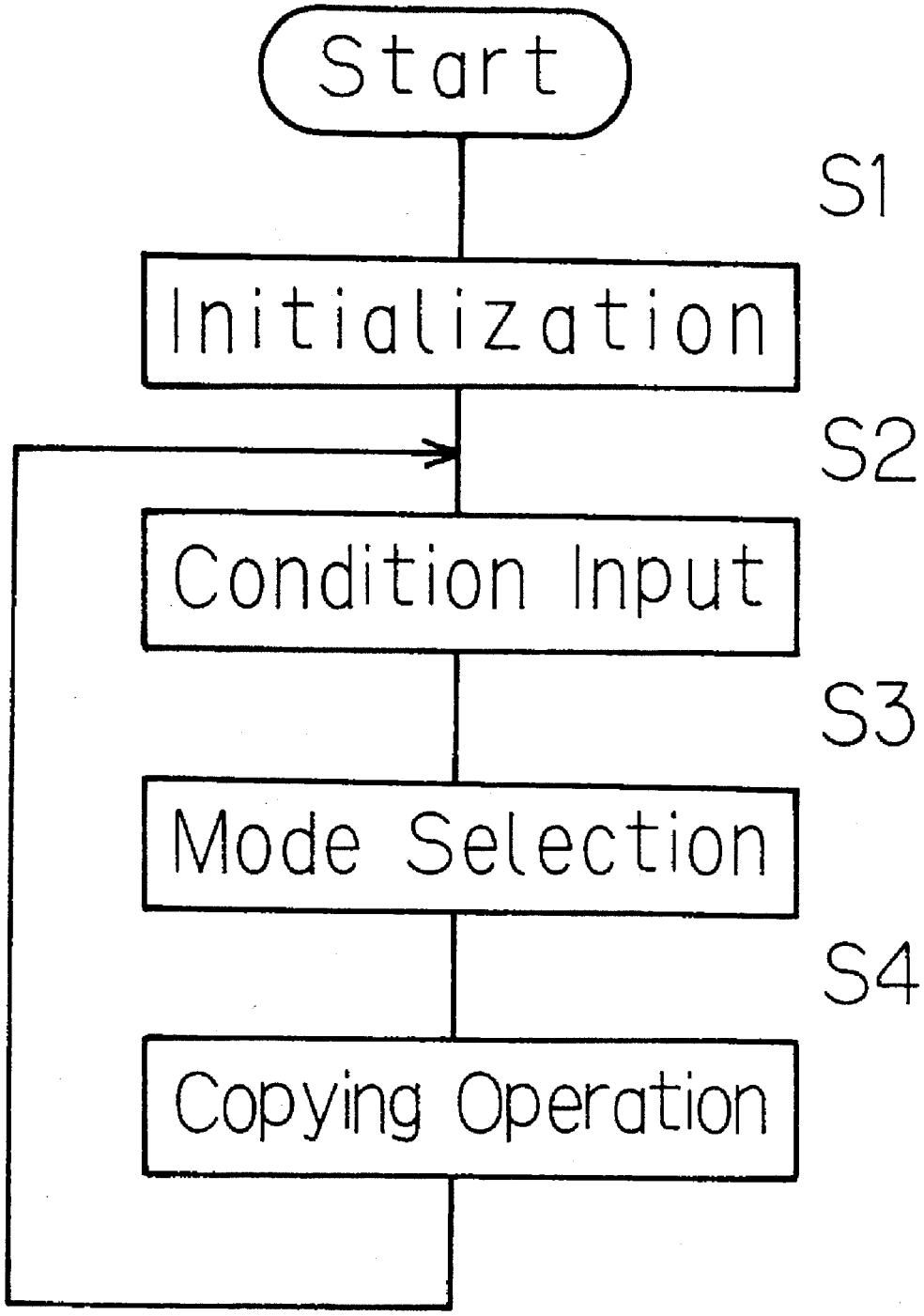
FIG. 15 is a control process flowchart of a copying machine body.

In the copying machine body 1, initialization procedure is carried out at step S1 in FIG. 15, wherein, for example, the number of copies is set to "1". In the initialization procedure, a non-sorting mode, a non-stapling mode and a non-punching mode are set.

Then, at step S2, a condition inputting operation such as receiving an input for setting the number of copies (i.e., quatity "Q") is performed. At step S3, a mode selecting operation to be described later is carried out. At step S4, a command for starting the copying operation is received through a print button. When the command for starting the copying operation is made, the copying operation is carried out by controlling each unit. During the copying operation, a sheet is transported from a feeding cassette 19 or a feeding deck 20 to the image forming unit 6 and then, a toner image is transferred onto the sheet in the image forming unit 6. Then, the image on the sheet is fixed by the fixing unit 14 and introduced to the inlet 28 of the sorter 2 by the discharge rollers 15. The operation in the sorter 2 will be described later. After the copying operation is finished at step S4, the program returns to step S2.

Operation of Sorter

Figure 16:
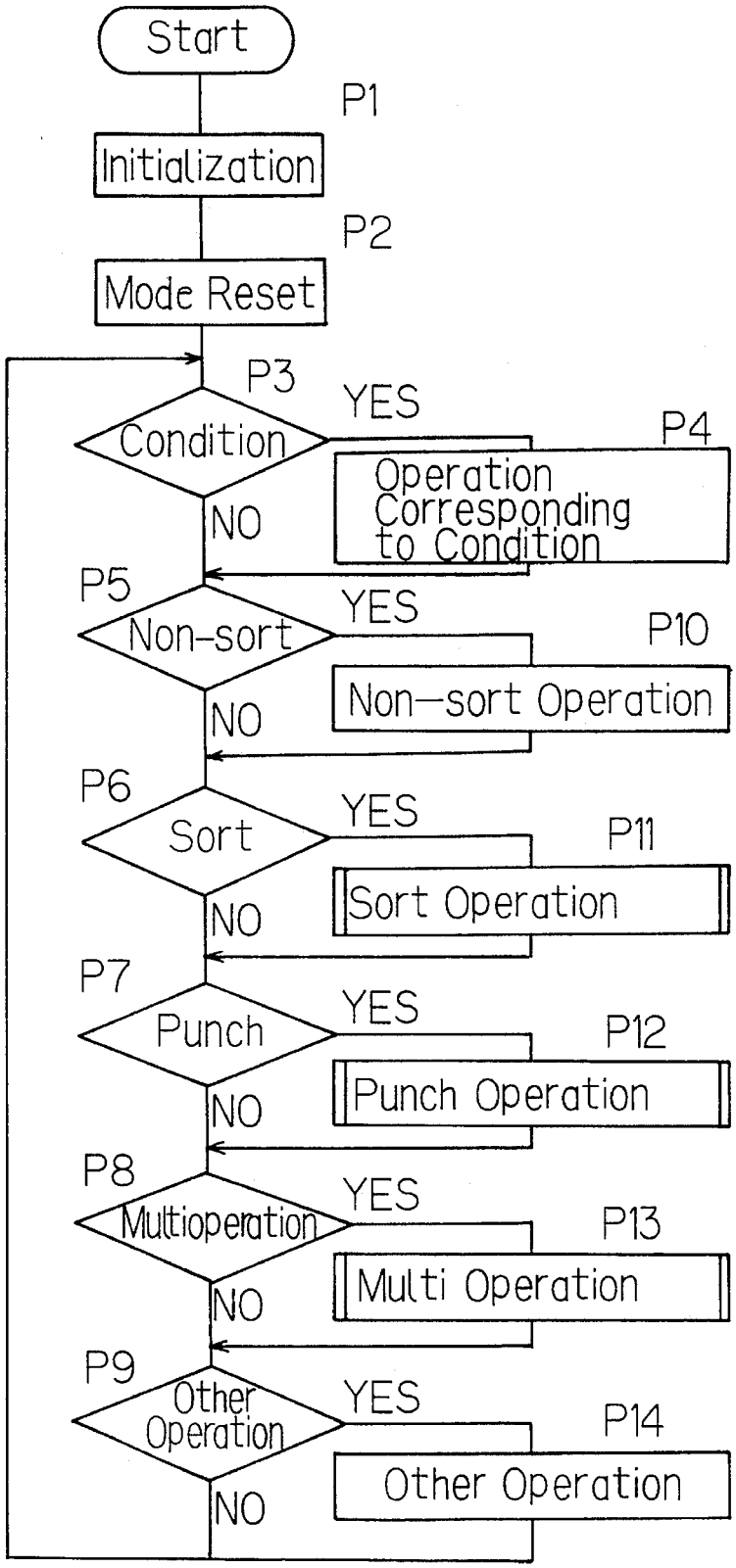
FIG. 16 is a control process flowchart of the sorter.

Initialization procedure is carried out at step P1 in FIG. 16 in the sorter 2. In the initialization procedure, for example, each of the stapler and the punching unit is disposed at an initial position, or the claw 81 is set to the bin 82 in which non-sorted sheets are stored.

At step P2, several kinds of modes are reset. As a result, the non-sorting mode referring to sorting/non-sorting mode, the non-stapling mode referring to stapling/non-stapling mode, and the non-punching mode referring to punching/non-punching mode are set.

Then, at step P3, it is determined whether information of the processing condition such as the number of sheets to be processed or contents of the set mode is output from the copying machine body 1 or not. Wherein there is an input of the processing condition, the program proceeds to step P4, wherein the operation mode corresponding to the condition is set.

It is determined at step P5 whether the operation mode is the non-sorting mode or not, at step P6 whether it is the sorting mode or not, at step P7 whether it is the punching mode or not, at step P8 whether it is the multimode or not, and step P9 whether it is another operation mode or not.

Wherein the operation mode is the non-sorting mode, the program proceeds from step P5 to step P10, wherein the non-sorting operation is carried out. Meanwhile, the sorting mode has been set, the program proceeds from step P6 to step P11, wherein the sorting operation is carried out. Wherein the punching mode has been set, the program proceeds from step P7 to step P12, wherein the punching operation is carried out. Meanwhile, wherein the multimode has been set, the program proceeds from step P8 to step P13, wherein the multioperation is carried out. Wherein the other mode is set, the program proceeds from step P9 to step P14, wherein the corresponding operation is carried out.

Figure 17:
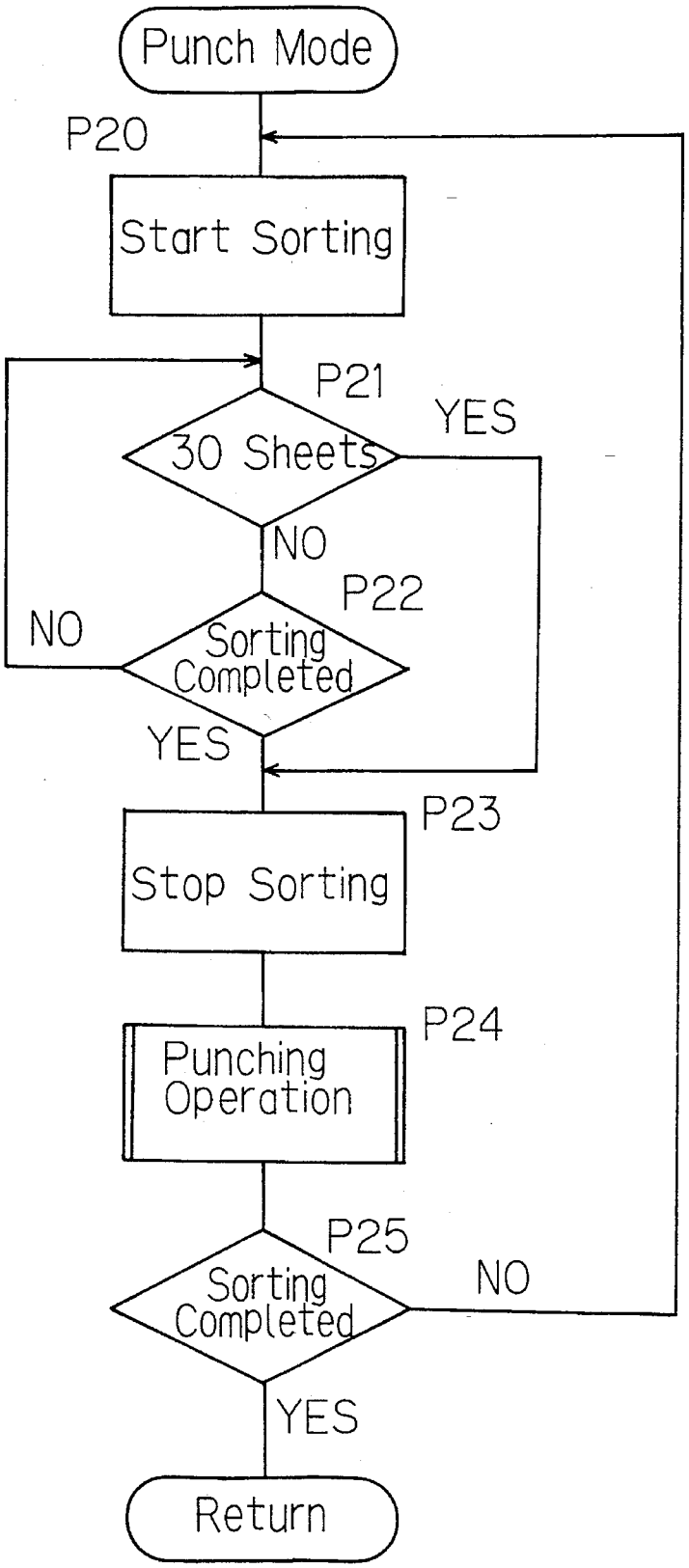
FIG. 17 is a flowchart of a punching operation.

Punching Operation

Wherein the punching mode has been set, the sorting operation is started at step P20 shown in FIG. 17. Then, it is determined at step P21 whether 30 sheets, for example, have been output to the bin 25 or not. Wherein they have not, the program proceeds to step P22. It is determined at step P22 whether the sorting operation for all sheets is finished or not. Wherein it is not, the program returns to step P21.

Thus, the operations at steps P21 and P22 are repeated. When the number of sheets stored in the bin 25 reaches 30 before the sorting operation is finished, the program proceeds from step P21 to step P23. Also, in the instance the sorting operation is finished before the number of sheets output to the bin 25 reaches 30, the program proceeds from step P22 to step P23. At step P23, the sorting operation is temporarily stopped. Then, at step P24, the punching operation is carried out. In the punching operation, a motor for driving the punch is rotated, whereby the lever 68 of the punching unit 60 is rotated and the punch 67 is lowered. If the punch 67 has not been detected to have returned to its home position after a predetermined time has elapsed after activation of the motor, it is determined that the punch hole has not been formed in all of the stacked sheets in bin 25 by a single punching operation. In this case, the punching operation is stopped, the motor is operated in reverse lifting the punch 67, and then the operation is repeated a second time. Wherein the punch 67 has still not been detected to have returned to its home position it is repeated again, and so on. Meanwhile, wherein the punch 67 has been detected to have returned to its home position within the predetermined time, the motor is stopped and the punching operation is finished. Then, the program proceeds to step P25.

It is determined at step P25 whether the sorting operation is finished or not. Wherein it is not, the program returns to step P20 and the sorting operation is started again. Thus, the above described operation is repeated until the sorting operation is finished at which time, this routine is finished.

According to the embodiment of the present invention, wherein the sorted stacked sheets can not be punched, the copying operation is interrupted and the punching operation is performed until a hole has been completely formed in the stacked sheets. Therefore, even when the bin carries a large quantity of sheets, the motor for driving the punch car be one designed for lighter duty.

Second Embodiment

Description of parts common to the first and second embodiments is omitted.

Figure 18:
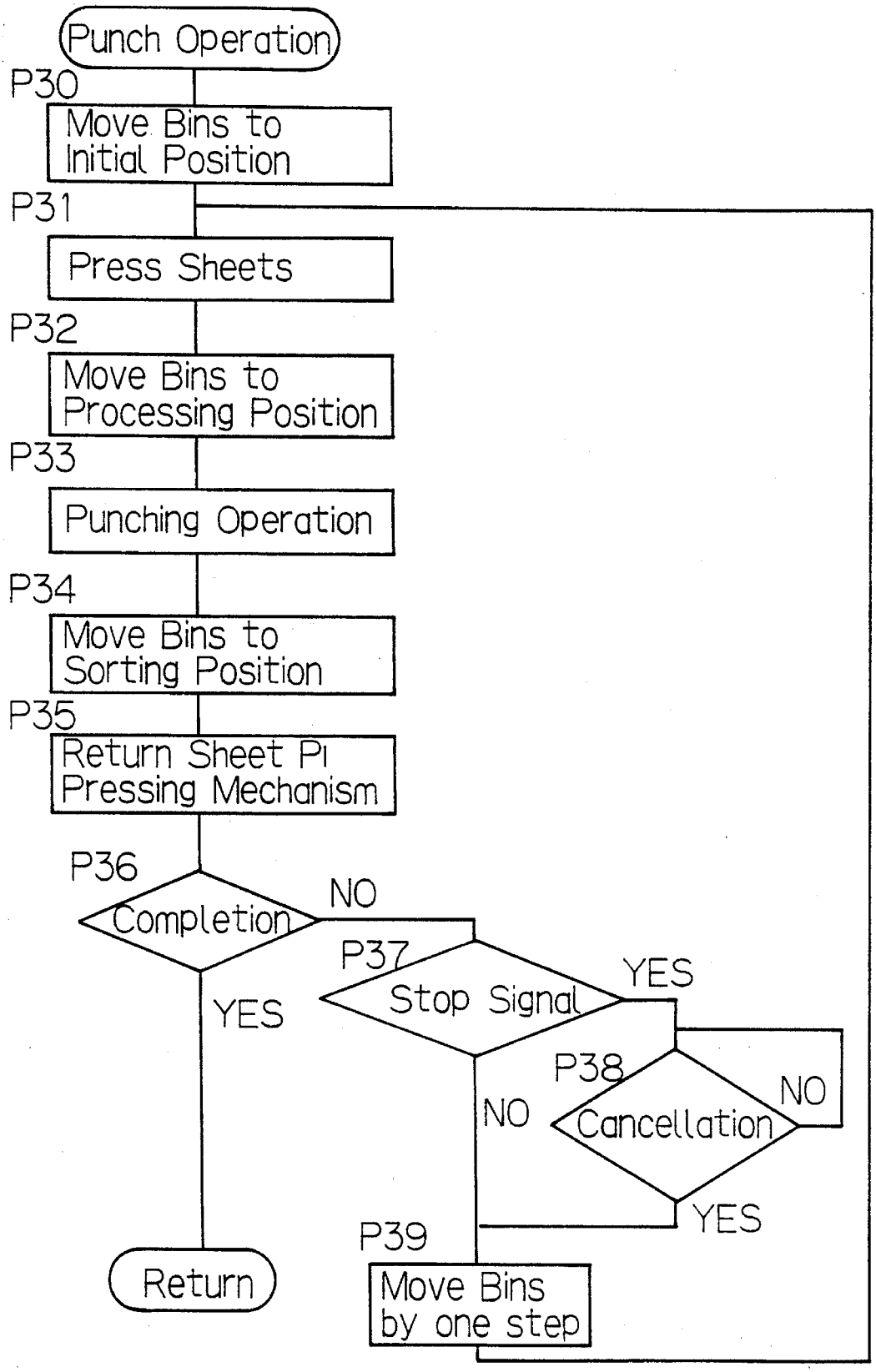
FIG. 18 is a flowchart of a punching operation according to another embodiment of the present invention.

According to the second embodiment of the present invention, wherein the punching mode is set, an operation shown in FIG. 18 is carried out.

First, at step P30, all bins 25 are moved to their initial positions for the punching operation. Then, at step P31, the sorted stacked sheets in the bin 25 are pressed by the sheet pressing mechanism. Then, at step P32, the bin 25 positioned opposite to the process unit 29 is withdrawn into a processing position in the process unit 29. Then, at step P33, the punching operation to be described later is carried out. At step P34, the bin 25 returns to the sorting position, and at step P35, the sheet pressing mechanism is removed from the stacked sheets. Then, it is determined at step P36 whether the punching operation is performed in all of the sorted stacks of sheets or not. Wherein it is not, the program proceeds to step P37. It is determined at step P37 whether a stop signal is output from the multistacker control unit 102 or not. Wherein the operation withdrawing the stacked sheets into the multistacker 3 is performed, since the stop signal is output from the multistacker control unit 102, the program proceeds to step P38. At step P38, there is a pause until the stop signal is canceled. Wherein the stop signal is not output and the stop signal is canceled, the program proceeds to step P39. At step P39, each bin is moved up one step and then, the program returns to step P31. After the punching operations is performed in all of the sorted stacked sheets, the determination at step P36 becomes YES and then, the subroutine for the punching operation is finished.

Figure 19:
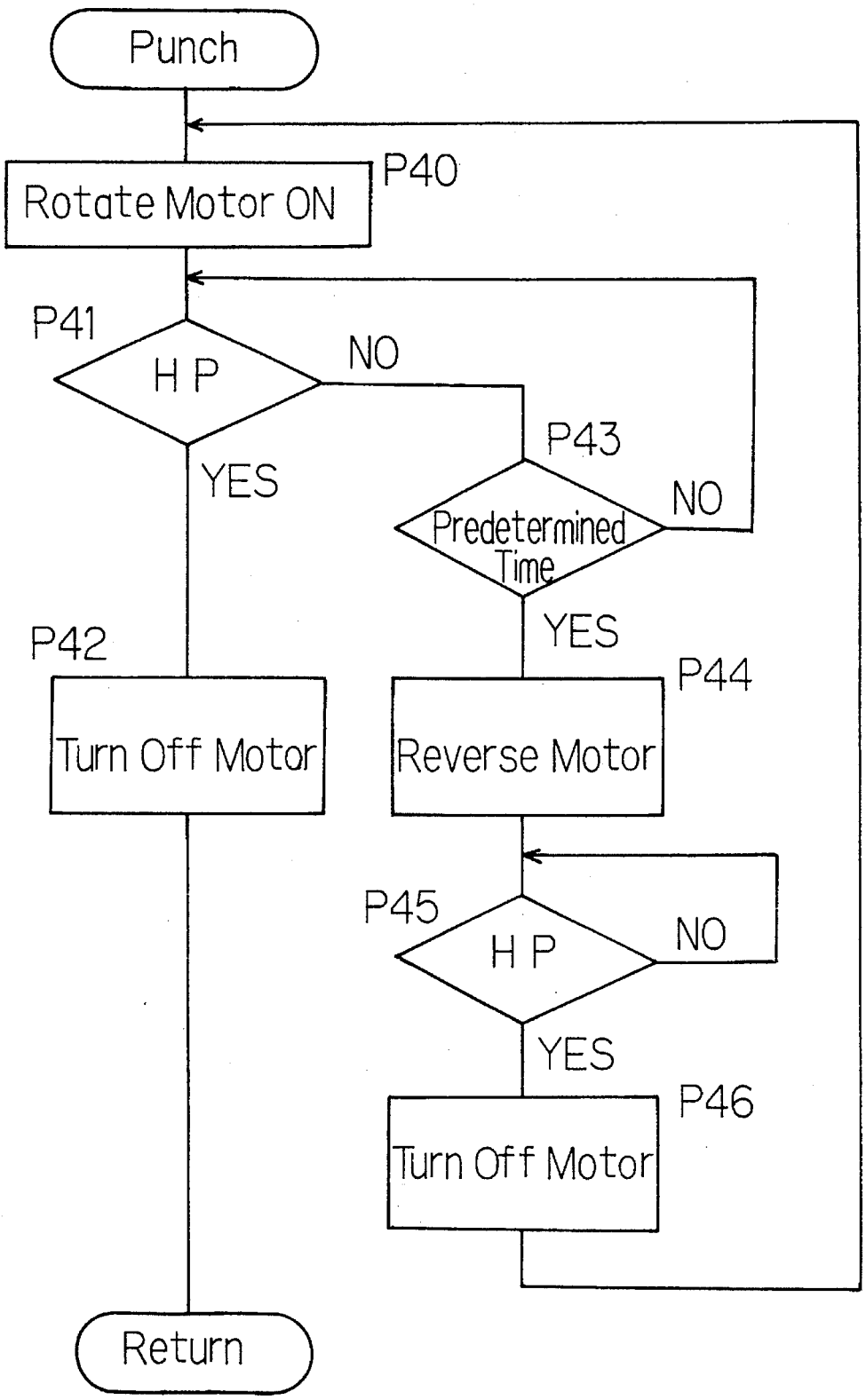
FIG. 19 is a flowchart of the punching operation according to the above embodiment of the present invention.

The control process of the punching operation at step P33 is shown in detail in FIG. 19. First, at step P40, the motor for driving the punch is rotated, whereby the lever 68 of the punching unit 60 is moved and the punch 67 is lowered. Then, it is determined at step P41 whether the punch 67 has returned to its home position or not. Wherein the punch 67 has returned to its home position, a punch hole is formed in all of the stacked sheets stored in the bin 25 by a single punching operation. In this case, the program proceeds from step P41 to step P42. At step P42, the motor is turned off.

It is determined at step P43 whether a predetermined time has elapsed after the motor was activated to rotate or not. Wherein the punch 67 has not returned to its home position after the predetermined time has elapsed, it is determined that the punch hole has not been completely formed in all of the stacked sheets in the bin 25 by a single punching operation. In this case, the program proceeds to step P44. At step P44, the motor for driving the punch is operated in reverse to lift the punch 67 having been locked up and stopped in the course of the punching operation. Then, it is determined at step P45 whether the punch 67 has thus returned to its home position or not. Wherein it has returned to the home position, the program proceeds to step P46, wherein the motor is temporarily stopped. Then, the program returns to step P40 and then, the above described operations are repeated until the punch hole is formed in all of the stacked sheets in the bin 25. Then, the punching operation is completed.

According to the embodiment of the present invention, when the punch hole has not been completely formed in all of the stacked sheets stored in the bin 25 by a single punching operation, the punching operation is repeated and so on. Therefore, even if a large quantity of sheets is stored in a large bin, the punch hole can be formed using a hole punching apparatus that is designed for lighter duty.

Modification

In the above embodiment, although the present invention is applied to a punching unit provided in the sorter of an image forming apparatus the present invention can also be applied to a punching unit provided in any image forming apparatus such as a copying machine having no sorter.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A sheet hole-punching unit in a copy-sheet processing station associated with a copying machine, comprising:

a punch for forming a hole through a stack of sheets;

a reversible drive means for driving the punch in one of a forward and a reverse direction;

a position-detecting means for determining whether the punch is in a home position; and a controller for actuating said drive means to forwardly drive said punch into hole punching contact with the stack of sheets and, upon said determining means determining that the punch has not returned to the home position within a reference period of time, for both actuating said drive means in reverse to return the punch to the home position and for reactuating said drive means to again move the punch in the forward direction so as to again contact the same stack of sheets, whereby the actuating of the drive means in reverse and the forward reactuation is repeated until the determining means determines that the punch has returned to the home position within the reference period of time.

2. A sheet hole-punching unit according to claim 1 wherein said reversible drive means includes a rotary driving unit and said sheet hole punching unit further comprising a positioning plate having a circumferential cutout, said positioning plate coupled for unitary rotation with said rotary driving unit, and wherein said position-detecting means comprises a sensor disposed adjacent said positioning plate for detecting coincidence of said cutout with said sensor.

3. An image forming apparatus having a punching function, comprising:

a sheet hole punching unit which includes a punch driven by a drive means and said sheet hole punching unit has a single-punch capacity C;

means for operating the image forming apparatus to produce unpunched copy sheets corresponding to an original document;

means for supplying the unpunched copy sheets into at least one sheet receiving bin of said image forming apparatus so as to form a copy sheet stack therein;

determining means for determining a quantity of unpunched copy sheets in the sheet stack;

means for detecting whether said means for supplying has stopped;

means for actuating the drive means to drive the punch into contact with the copy sheet when said determining means determines the quantity to be less than C and when said detecting means also determines said means for supplying has stopped;

means for sending a control signal to said means for supplying the unpunched copy sheets when said determining means determines the quantity to be equal to C so as to halt the supply of copy sheets into the receiving bin prior to said actuating means driving the punch into contact with the copy sheet stack;

means for reinitiating the halted supplying means following actuation of the means for actuating when the determined quantity C is less than a total quantity of copy sheets to be produced from the original document being copied and supplied to the receiving bins.

4. An image forming apparatus as recited in claim 3 wherein said drive means includes a drive motor that runs in both a forward and a reverse direction and said hole punching unit further comprises a position-detecting means for determining whether the punch is in a home position, and said apparatus further comprising time determining means for determining if a predetermined period of time from a forward actuation of said motor has elapsed, and means for controlling said motor so as to first run said motor in a reverse direction if said punch is not in a home position upon said time determining means determining the predetermined time period has elapsed and then in a forward direction so as to again place said punch in hole punching contact with the stack of sheets in said bin.

5. A method for operating a sheet hole-punching unit associated with a copying machine, the hole-punching unit including a punch driven by a reversible drive means, and a position-detecting means for determining whether the punch is in a home position, the method comprising the steps of:

supplying a stack of sheets into a sheet stack hole-punching position of the hole-punching unit;

actuating the drive means to drive the punch into hole punching contact with the stack of sheets;

determining from the position-detecting means of the sheet hole-punching unit, upon elapse of a reference period of time, whether the punch is in the home position; and upon said determining step determining that the punch is not in the home position upon elapse of the reference period of time, repeating said actuating step, following actuating the drive means in reverse to return the punch to the home position, until said determining step determines that the punch is in the home position within the reference period of time, and upon said determining step determining that the punch is in the home position upon elapse of the reference period of time, cutting off actuation of the drive means.

6. A method for operating a sheet hole-punching unit associated with a copying machine, the hole-punching unit including a punch driven by a drive means, wherein the sheet hole-punching unit has a single-punch sheet capacity C, the method comprising the steps of:

(a) operating a copying machine in an effort to produce a quantity Q of copy sheets corresponding to an original document;

(b) supplying unpunched copy sheets corresponding to the original document into a sheet receiving bin so as to form a copy sheet stack therein, said supplying to the bin being ended upon quantity Q having been reached in the copy sheet stack;

(c) detecting during step (b) what quantity of unpunched sheets is in the copy sheet stack;

(d) in response to the detecting in step (c) of an unpunched copy sheet quantity of less than C and a determination that step (b) has ended, actuating the drive means in an effort to drive the punch through the copy sheet stack;

(e) in response to a situation wherein quantity Q is equal to C and a detecting in step (c) of an unpunched copy sheet quantity of C, actuating the drive means in an effort to drive the punch through the copy sheet stack;

(f) in response to a situation wherein quantity Q is greater than C and a detecting in step (c) of an unpunched copy sheet quantity of C, (i) sending a control signal to the copying machine for halting the supply of copy sheets into the receiving bin if quantity Q has not already been reached, (ii) actuating the drive means in an effort to drive the punch through the copy sheet stack; and (iii) sending a control signal to reinitiate the supplying of unpunched copy sheets unless a quantity Q of copy sheets has been punched; and (g) repeating steps (a) through (f) if step (b) has not ended.

7. A method as recited in claim 6 wherein operating the copying machine includes producing a plurality of quantity Q of copy sheets with each quantity of Q of copy sheets being received within a respective one of a plurality of sorter bins of a sorter apparatus.

8. A method as recited in claim 7 further comprising shifting the position of said sorter bins into a feeding position with respect to said hole-punching unit.

9. A method for operating a sheet hole-punching unit associated with a copying machine, the hole-punching unit including a punch driven by a reversible drive means and a position-detecting means for determining whether the punch is in a home position, wherein the sheet hole-punching unit has a single-punch capacity C, the method comprising the steps of:

(a) operating a copy machine in an effort to produce a quantity Q of copy sheets corresponding to an original document;

(b) supplying unpunched copy sheets corresponding to the original document into a sheet-receiving bin so as to form a copy sheet stack therein, said supplying to the bin being ended upon quantity Q having been reached in the copy sheet stack;

(c) detecting during step (b) what quantity of unpunched sheets is in the copy sheet stack;

(d) in response to the detecting in step (c) of an unpunched copy sheet quantity of less than C and a determination that step (b) has ended, actuating the drive means in an effort to drive the punch through the copy sheet stack;

(e) in response to a situation wherein quantity Q is equal to c and a detecting in step (c) of an unpunched copy sheet quantity of C, actuating the drive means in an effort to drive the punch through the copy sheet stack;

(f) in response to a situation wherein quantity Q is greater than C and a detecting in step (c) of an unpunched copy sheet quantity of C, (i) sending a control signal to the copying machine for halting the supply of copy sheets into the receiving bin if quantity Q has not already been reached, (ii) actuating the drive means in an effort to drive the punch through the copy sheet stack, and (iii) sending a control signal to reinitiate the supply of unpunched copy sheets unless a quantity Q of copy sheets has been punched; wherein said steps (d), (e) and (f) further include:

determining from the position-detecting means of the sheet hole-punching unit, upon elapse of a predetermined period of time, whether the punch is in the home position; and upon said determining step determining that the punch is not in the home position within the predetermined period of time, repeating said actuating step following actuating the drive means in reverse to return the punch to the home position; and upon said determining step determining that the punch is in the home position upon elapse of the predetermined period of time, cutting off actuation of the drive means; and (f) repeating steps (a) through (f) until the quantity Q of sheets has been punched through.

* * * * *